US005133131A

United States Patent [19]

Hoffman

[11] Patent Number: 5,133,131

[45] Date of Patent: Jul. 28, 1992

[54] REPLACEABLE DOUBLE-SIDED RAZOR BLADE UNIT

[76] Inventor: Ralph H. Hoffman, 27 Lakeshore, Grosse Pointe Shores, Mich. 48236

[21] Appl. No.: 740,160

[22] Filed: Aug. 5, 1991

[51] Int. Cl.[5] ..... B26B 21/00

[52] U.S. Cl. ..... 30/50; 30/47

[58] Field of Search ..... 30/32, 50, 51, 65, 74.1, 30/47, 48, 49

[56] References Cited

U.S. PATENT DOCUMENTS

| | | | |
|---|---|---|---|
| D. 174,037 | 2/1955 | Glaberson . | |
| D. 193,299 | 7/1962 | Dreyfuss . | |
| 228,829 | 6/1880 | Moody . | |
| D. 248,878 | 8/1978 | Halm . | |
| D. 269,466 | 6/1983 | Gruber . | |
| D. 282,878 | 3/1986 | Skidmore . | |
| 1,425,463 | 8/1922 | Fischer . | |
| 2,505,493 | 4/1950 | Herrmann . | |
| 2,598,104 | 5/1952 | Bianchi . | |
| 3,052,023 | 9/1962 | Meohas . | |
| 3,078,569 | 2/1963 | Sidney et al. . | |
| 3,768,162 | 10/1973 | Perry . | |
| 3,777,396 | 12/1973 | Simonetti . | |
| 3,832,774 | 9/1974 | Perry . | |
| 3,934,338 | 1/1976 | Braginetz | 30/50 |
| 4,285,125 | 8/1981 | Chen et al. . | |
| 4,461,078 | 7/1984 | Carreker . | |
| 4,473,944 | 10/1984 | Carroll . | |
| 4,501,066 | 2/1985 | Sceberras . | |
| 4,754,548 | 6/1988 | Solow . | |
| 4,993,153 | 2/1991 | Henry . | |

*Primary Examiner*—Douglas D. Watts
*Attorney, Agent, or Firm*—Basile and Hanlon

[57] ABSTRACT

A replaceable, double-sided blade unit is disclosed for use with a handle member in a shaving system. The handle member has an elongated grip portion and a blade unit support member extending transversely to the axis of the grip portion. The support member includes a pair of flange portions, with the flange portions extending transversely to the support member and projecting in directions generally opposed to one another. A member is provided for connecting the grip portion to the support member. The blade unit comprises an elongated body portion having a base, a cap member, and two opposed guard surfaces for contact with the skin. A razor blade portion is disposed between the base and the cap member. The razor blade portion has at least one pair of separate, opposed, thin, planar elongated cutting members permanently fixed to the body portion with their cutting edges disposed parallel to, and spaced from their respective opposed guard surfaces in shaving relation to the guard surfaces. A mechanism is formed in the base of the body portion for releasably attaching the blade unit to the blade unit support member in shaving relation thereto. The releasable attaching mechanism comprises two, spaced attaching recesses disposed parallel to the cutting edges and extending along the length of the body portion, with the attaching recesses being adapted to receive the handle flange portions.

4 Claims, 1 Drawing Sheet

FIG-1
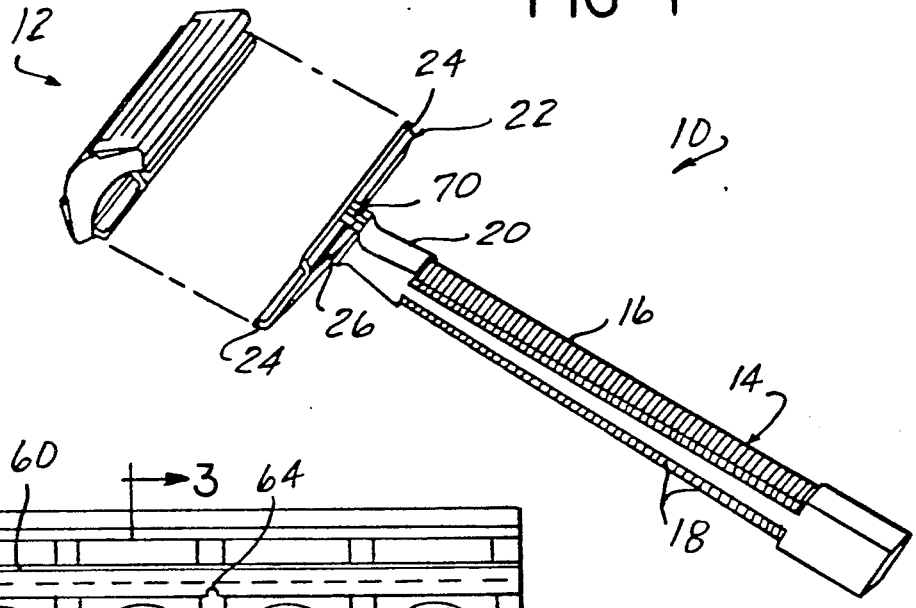
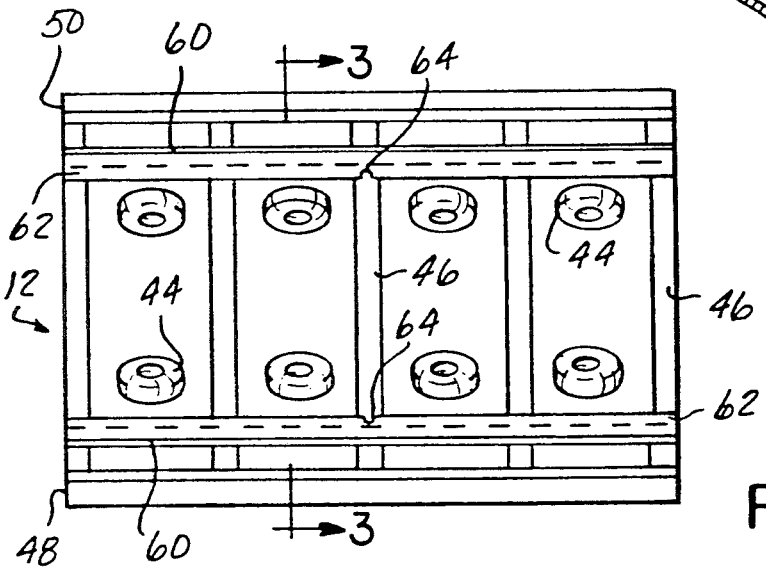
FIG-2
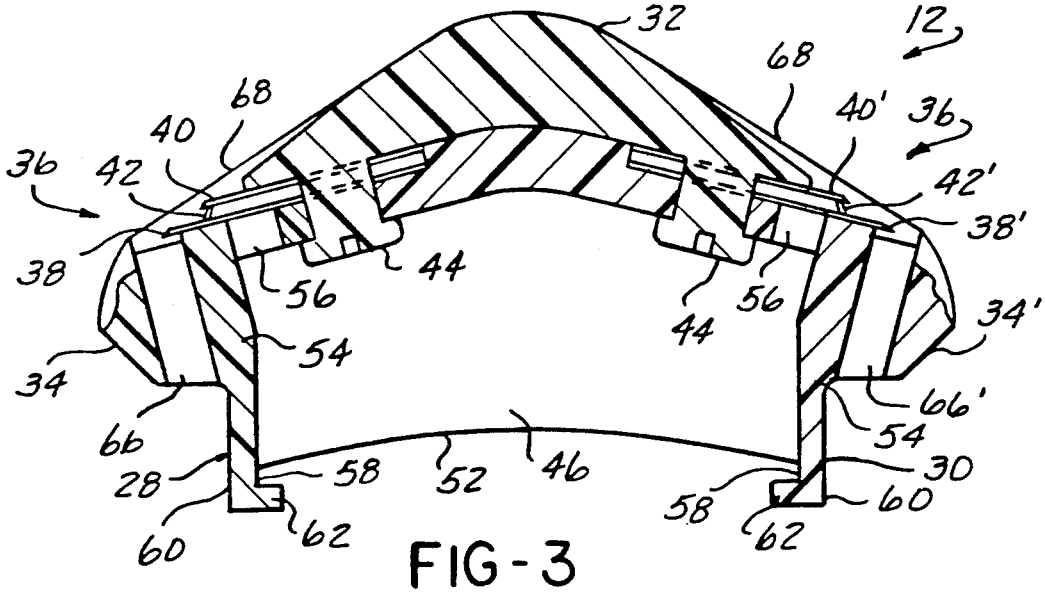
FIG-3

REPLACEABLE DOUBLE-SIDED RAZOR BLADE UNIT

BACKGROUND OF THE INVENTION

1. Field of the Invention

The present invention relates generally to shaving systems, and more particularly to a replaceable, double-sided blade unit for a shaving system, the blade unit having at least two blade elements permanently secured in a predetermined geometrical relationship to at least two guard elements.

2. Description of the Relevant Art

Designers of razors are continually seeking new and improved razor systems adapted to permit shaving while moving the razor forwardly and rearwardly. In order to be a useful, marketable and profitable venture, such a design should protect against nicks, cuts and other injury to the user, yet should also be a versatile design, simple to mass produce, package and market.

In the past, several attempts have been made to produce such a razor. In U.S. Pat. No. 3,777,396 issued to Simonetti, a razor cartridge has tandemly mounted cutting edges on two sides of the cartridge. The cartridge utilizes two double edged blades, with one edge of each blade extending out of one side of the cartridge, and the other edge of each blade extending out of the other side of the cartridge. The double edged blades are separated by a spacer secured between a cap member and a blade seat member. The cap member, blade seat member and spacer are all curved, and thus bend the double edged blades such that the edges of the blades are bent into an offset, spaced parallel relationship. Due to the required curvature and structure of the cap member, the spacer and the blade seat member, the manufacture of this razor would necessitate a dedicated facility adapted to produce only this type of razor. However, this dedication of resources is too costly a proposition in today's diversified and competitive business arena.

In U.S. Pat. No. 4,501,066 issued to Sceberras, another dual headed razor system is disclosed. This system is even more complex than that mentioned above, in that the duality is achieved by the handle supporting a pair of separately detachable razor cartridges. Thus, the handle would have to be specially manufactured, and the disadvantages set forth above would apply equally well here. In addition, such a system would be more time consuming, expensive and annoying to use, in that two cartridges would have to be purchased and installed each time the blades became dull.

Thus, it would be desirable to provide a replaceable, double-sided razor blade unit which can be used on existing handles usable with single sided blade units. In addition, it would be desirable to provide such a blade unit which can be manufactured in the same facility with single sided blade units, with only minor modification to the existing facilities.

SUMMARY OF THE INVENTION

The problems enumerated above are solved by the present invention which discloses a replaceable, double-sided blade unit for use with a handle member in a shaving system. The handle member has an elongated grip portion and a blade unit support member extending transversely to the axis of the grip portion. The support member includes a pair of flange portions, with the flange portions extending transversely to the support member and projecting in directions generally opposed to one another. A member is provided for connecting the grip portion to the support member.

The blade unit comprises an elongated body portion having a base, a cap member, and two opposed guard surfaces for contact with the skin. A razor blade portion is disposed between the base and the cap member. The razor blade portion has at least one pair of separate, opposed, thin, planar elongated cutting members permanently fixed to the body portion with their cutting edges disposed parallel to and spaced from their respective opposed guard surfaces in shaving relation to the guard surfaces. Means, formed in the base of the body portion, are provided for releasably attaching the blade unit to the blade unit support member in shaving relation thereto. The releasable attaching means comprises two, spaced attaching recesses disposed parallel to the cutting edges and extending along the length of the body portion, with the attaching recesses being adapted to receive the handle flange portions.

BRIEF DESCRIPTION OF THE DRAWINGS

Other objects and features of the invention will become apparent by reference to the following specification and to the drawings in which:

FIG. 1 is a perspective view of the double-sided razor blade unit of the present invention, shown exploded away from the handle member;

FIG. 2 is a bottom view of the blade unit shown in FIG. 1; and

FIG. 3 is an enlarged cross sectional view taken on line 3—3 in FIG. 2.

DETAILED DESCRIPTION OF THE PREFERRED EMBODIMENTS

Referring now to FIG. 1, the shaving system of the present invention is designated generally as 10. The replaceable, double-sided blade unit of shaving system 10 is designated generally as 12. The blade unit is for use with a handle member 14. Handle member 14 has an elongated grip portion 16, with ridges 18 along a portion of the length of grip portion 16, for facilitating handling by the user. At the upper end of grip portion 16 is a neck portion 20. A blade unit support member 22 extends transversely to the axis of grip portion 16. Support member 22 includes a pair of flange portions 24 which extend transversely to support member 22 and project in directions generally opposed to one another. A member 26 connects grip portion 16 to support member 22. Although the above-described structure of handle member 14 is preferred, it is to be understood that the present invention is not limited to use with such a structure, and that use of any suitable handle member is contemplated.

Referring now more particularly to FIGS. 2 and 3, double-sided blade unit 12 comprises an elongated body portion 28 having a base 30, a cap member 32, and two opposed guard surfaces 34, 34' for contact with the skin. Base 30 is molded from a high impact polystyrene, or any other suitable polymeric material. A razor blade portion 36 is disposed between base 30 and cap member 32. Razor blade portion 36 has at least one pair of separate, opposed, thin, planar elongated cutting members 38, 38' permanently fixed to body portion 28 with their cutting edges disposed parallel to, and spaced from their respective opposed guard surfaces 34, 34' in shaving relation to guard surfaces 34, 34'.

In the preferred embodiment, two pairs of separate, opposed, thin, planar elongated cutting members 38, 38' and 40, 40' are permanently fixed to body portion 28. Each respective cutting member 38, 38' of one pair is lower than, extends outwardly offset from, and in parallel relation to each respective cutting member 40, 40' of the other pair. Blade unit 12 may further comprise means for preventing the respective cutting members 38, 38' and 40, 40' from moving out of the parallel, offset relationship with respect to each other. The preventing means may comprise any suitable means, but in the preferred embodiment, this means comprises spacer members 42, 42' interposed between cutting member edges 38, 40 and 38', 40'.

Cap member 32 is similarly molded of high impact polystyrene or any other suitable polymeric material. Pins 44 depend from cap member 32 and extend through apertures in cutting members 38, 38', 40, 40', spacer members 42, 42' and base 30, and are cold headed to secure the cutting members and spacer members to base 30. Webs 46 extend between opposed wall portions 48, 50, and the lower surfaces 52 of webs 46 define a plane that is angularly disposed to platform surfaces 54. Apertures 56 are aligned with apertures in blades 38, 38' to permit shaving debris to flow through base 30 away from the shaving area.

Blade unit 12 further comprises means, formed in the base 30 of body portion 28, for releasably attaching blade unit 12 to blade unit support member 22 in shaving relation thereto. The releasable attaching means comprises two, spaced attaching recesses 58 disposed parallel to the cutting edges 38, 38' and 40, 40' and extending along the length of body portion 28. Attaching recesses 58 are adapted to receive handle flange portions 24. Two spaced wall extensions 60 extend downwardly and essentially perpendicularly away from surface 52. Each wall extension 60 has at its lower end an inturned flange 62 that projects inwardly in order to define attaching recesses 58.

Web extensions 66, 66' support guard surfaces 34, 34'. Low height, upstanding walls 68 provide a glide surface for the razor head and supplement guard surface 34, 34' in preventing nicks and cuts.

Blade unit 12 may further comprise means for inhibiting transverse movement of blade unit 12 with respect to blade unit support member 22. This inhibiting means may comprise any suitable means. In the preferred embodiment, as seen in FIG. 1, this inhibiting means comprises a spring plate 70 disposed on support member 22, spring plate 70 being adapted to bias against a blade unit 12 when attached to support member 22. Spring plate 70 may be formed on either or both sides of handle member 14. Blade unit 12 may further include a notch 64 in flange 62, the notch 64 being for engagement with any suitable, complementary latch structure disposed on handle member 14. Spring plate 70 may function as the resilient latch member and cooperate with flange portion 24 and notch 64 to secure blade unit 12 on handle member 14. Although two notches 64 are shown in FIG. 2, it is to be understood that one notch 64 may function equally as well, and also that spring plate 70 may function as the inhibiting means without need for any notch 64.

One of the advantageous aspects of the present invention is that it permits shaving forwardly and rearwardly with proper wrist motion without turning the razor completely upside down to orient a single-sided blade cartridge into shaving relation with a user's skin. As one consequence of this, a single double-sided cartridge as disclosed in the present invention will last twice as long as a cartridge containing only one set of blades. Further, the double-sided blade unit 12 can easily be utilized on existing handles which carry cartridges having only one set of blades. Due to this, and also due to the fact that only minor modifications of existing molds and tooling adapted to produce single-sided cartridges would be necessary in order to produce the present invention, existing manufacturing facilities could be used. This would render a manufacturing plant versatile, and also make the present invention simple to mass produce, package and market.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A replaceable, double-sided blade unit for use with a handle member in a shaving system, the handle member having an elongated grip portion, a blade unit support member extending transversely to the axis of the grip portion, the support member including a pair of flange portions, the flange portions extending transversely to the support member and projecting in directions generally opposed to one another, and a member for connecting the grip portion to the support member, the blade unit comprising:

an elongated body portion having a base, a cap member, and two opposed guard surfaces for contact with the skin;

a razor blade portion disposed between the base and the cap member, the razor blade portion having at least one pair of separate, opposed, thin, planar elongated cutting members permanently fixed to the body portion with their cutting edges disposed parallel to, and spaced from their respective opposed guard surfaces in shaving relation to the guard surfaces;

means, formed in the base of the body portion, for releasably attaching the blade unit to the blade unit support member in shaving relation thereto, the releasable attaching means comprising two, spaced attaching recesses disposed parallel to the cutting edges and extending along the length of the body portion, the attaching recesses being adapted to receive the handle flange portions; and means for inhibiting transverse movement of the blade unit with respect to the blade unit support member, wherein the inhibiting means comprises a spring plate disposed on the support member, the spring plate adapted to bias against a blade unit attached to the support member.

2. The replaceable, double-sided blade unit as defined in claim 1 wherein the razor blade portion comprises two pairs of separate, opposed, thin, planar elongated cutting members, each respective cutting member of one pair being lower than, extending outwardly from, and in parallel relation to each respective cutting member of the other pair, the blade unit further comprising:

means for preventing the respective cutting members from moving out of the parallel relationship with respect to each other.

3. The replaceable, double-sided blade unit as defined in claim 2 wherein the preventing means comprises a spacer member interposed between the respective cutting member edges.

4. A replaceable, double-sided blade unit for use with a handle member in a shaving system, the handle member having an elongated grip portion, a blade unit support member extending transversely to the axis of the grip portion, the support member including a pair of flange portions, the flange portions extending transversely to the support member and projecting in directions generally opposed to one another, and a member for connecting the grip portion to the support member, the blade unit comprising:

an elongated body portion having a base, a cap member, and two opposed guard surfaces for contact with the skin;

a razor blade portion disposed between the base and the cap member, the razor blade portion having two pairs of separate, opposed, thin, planar elongated cutting members, each respective cutting member of one pair being lower than, extending outwardly from, and in parallel relation to each respective cutting member of the other pair, each pair of cutting members being permanently fixed to the body portion with their cutting edges disposed parallel to, and spaced from their respective opposed guard surfaces in shaving relation to the guard surfaces;

means for preventing the respective cutting members from moving out of the parallel relationship with respect to each other, wherein the preventing means comprises a spacer member interposed between the respective cutting member edges;

means, formed in the base of the body portion, for releasably attaching the blade unit to the blade unit support member in shaving relation thereto, the releasable attaching means comprising two, spaced attaching recesses disposed parallel to the cutting edges and extending along the length of the body portion, the attaching recesses being adapted to receive the handle flange portions; and means for inhibiting transverse movement of the blade unit with respect to the blade unit support member, wherein the inhibiting means comprises a spring plate disposed on the support member, the spring plate adapted to bias against a blade unit attached to the support member.

* * * * *